US007174874B2

(12) United States Patent
Horikoshi

(10) Patent No.: US 7,174,874 B2
(45) Date of Patent: Feb. 13, 2007

(54) RECOIL STARTER

(75) Inventor: Yoshinori Horikoshi, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 11/241,915

(22) Filed: Oct. 4, 2005

(65) Prior Publication Data

US 2006/0070596 A1 Apr. 6, 2006

(30) Foreign Application Priority Data

Oct. 6, 2004 (JP) ..... P2004-294184
Dec. 27, 2004 (JP) ..... P2004-377599

(51) Int. Cl.
*F02N 3/02* (2006.01)

(52) U.S. Cl. ..... 123/185.3

(58) Field of Classification Search ..... 123/185.3, 123/185.14, 185.2, 185.4; 185/39, 40 R, 185/41 R, 41 A, 41 C
See application file for complete search history.

(56) References Cited

U.S. PATENT DOCUMENTS 6,971,359 B2 * 12/2005 Tohyama ..... 123/185.3
2003/0094154 A1 * 5/2003 Morishige et al. ..... 123/185.3
2003/0213455 A1 * 11/2003 Tohyama ..... 123/185.3
2004/0016311 A1 * 1/2004 Hashiba ..... 74/8
2004/0123827 A1 7/2004 Tsunoda et al.
2004/0149249 A1 * 8/2004 Kruse et al. ..... 123/185.3
2004/0250787 A1 12/2004 Tohyama
2005/0252477 A1 * 11/2005 Schriever et al. ..... 123/185.14

FOREIGN PATENT DOCUMENTS

JP 2003-336567 11/2003

* cited by examiner

*Primary Examiner*—Stephen K. Cronin
*Assistant Examiner*—Arnold Castro
(74) *Attorney, Agent, or Firm*—Nixon & Vanderhye P.C.

(57) ABSTRACT

A coil starter formed so that the rotation of a rope reel is transmitted to a cam member via a coil spring-like damper spring both ends of which are engaged with the rope reel and cam member respectively, wherein the rope reel or cam member is provided with a boss portion the length of which is substantially equal to that of a wound portion of the damper spring, the inner circumferential side of substantially the whole length of the damper spring being supported on the boss portion, the wound portion of substantially the whole length of the damper spring being thereby wound uniformly and tightly around the outer circumferential surface of the boss portion when the damper spring is elastically deformed due to the engine starting resistance.

4 Claims, 11 Drawing Sheets

RECOIL STARTER

BACKGROUND OF THE INVENTION

1. Field of the Invention

The present invention relates to a recoil starter adapted to rotate a rope reel by drawing an end of a recoil rope wound around the rope reel and drawn to the outside of a recoil rope case, transmit the rotation of the rope reel to a cam member via a damper spring, transmit the rotation of the cam member to an engine via a ratchet mechanism, and thereby start the engine.

2. Description of the Related Art

A recoil starter has already been known which is adapted to rotate a rope reel, around which a recoil rope is wound, by drawing the recoil rope, rotate a rotary member of an engine connected to a cam member, which is driven by the rope reel, via a ratchet mechanism, and thereby start the engine, wherein a damper spring wound like a return coil spring is interposed between the rope reel and cam member, the damper spring elastically connecting in the rotational direction the rope reel and cam member together via the damper spring so that the rotation made by the drawing of the recoil rope of the rope reel is transmitted to the cam member via the damper spring, a shock transmitted to the hand, which draws the recoil rope, due to the variation and the like of a load on the engine at the time of the starting thereof being thereby absorbed, the rotary member connected to the engine being rotated at a high speed by the energy accumulated in the damper spring, the starting of the engine being thereby done with ease.

In a related art recoil starter, a rope reel around which a recoil rope is wound, and a cam member connected to a rotary member fixed to an engine via a ratchet mechanism, such as a centrifugal clutch and the like are arranged in an opposed state, and an annular recess is formed in an opposed surface of each of the rope reel and cam member, a coil spring-like damper spring being housed in the annular recess, one end, which is bent in the shape of the letter "U", of the damper spring being engaged with the rope reel with the other end, which is bent in the axial direction of the damper spring, engaged with an opening formed in the cam member, the rope reel and cam member being thereby rotatably connected together via the damper spring. When the rope reel is rotated by drawing the recoil rope wound therearound, the cam member is rotated via the damper spring, and the rotation of the cam member causes a crankshaft of an engine to be rotated via the ratchet mechanism formed between the cam member and engine, the engine being thereby started, as disclosed in JP-A-2003-336567.

According to the related techniques, the annular recess, which houses a coil spring-like damper spring therein, formed in the rope reel and cam member is provided with a boss portion extending in a projecting manner from the rope reel and cam member so that the rope reel and cam member is abutted on each other at the substantially central portion of the damper spring with respect the longitudinal direction thereof, the damper spring being arranged on the outer circumferential surfaces of the two boss portions. Therefore, when the damper spring absorbs a large load on the engine and is distorted to cause the diameter of the wound damper spring to be reduced, the damper spring is wound tightly on the outer circumferential surfaces of the boss portions of the rope reel and cam member. During this time, a part of the damper spring enters a clearance between the abutted surfaces of the two boss portions, and held therebetween. This causes the damper spring to be one-sidedly deformed, or both end portions of the damper spring are tightly wound around the boss portion of the rope reel and that of the cam member. When the rope reel and cam member in this condition are relatively rotated, only the central portion of the damper spring that is near the abutted surface of the two boss portions is greatly deformed to cause in some cases the damper spring to be broken, or the durability thereof to be spoiled.

SUMMARY OF THE INVENTION

The present invention aims at solving the problems of the above-described related techniques, and improving the durability of the damper spring while preventing the occurrence of an excessively large deformation of the damper spring even when the damper spring is displaced due to a large load on the engine and wound tightly around the outer circumferential surfaces of the boss portions supporting the damper spring.

In order to solve the problems, the recoil starter according to a first aspect of the invention includes a rope reel which has therearound a recoil rope, one end of which is drawn out to the outer side of a case, is wound, and which is mounted pivotably on a reel support shaft formed on the inner side of the case, a coil spring adapted to urge the rope reel pivotally in the recoil rope take-up direction, a cam member mounted pivotably on the reel support shaft so that the cam member is opposed to the rope reel, and adapted to transmit rotation to the engine via a ratchet mechanism, and a coil spring-like damper spring both ends of which are engaged with the rope reel and cam mechanism, the rotational force of the rope reel being transmitted to the cam member via the elastic force of the damper spring, the rotation of the cam member being transmitted to the engine via the ratchet mechanism, the engine being thereby started, wherein a boss portion the length of which is substantially equal to that of a wound portion of the damper spring is formed on either one of the rope reel or cam member, the inner circumferential side of the damper spring of substantially the whole length thereof being supported on the boss portion, the wound portion of the damper spring of substantially the whole length thereof being wound tightly around the outer circumferential surface of the boss portion when the damper spring is elastically deformed due to the starting resistance of the engine.

In a second aspect of the invention, the wire material forming the damper spring is set to such a sectional shape that extends linearly at least one side thereof, this wire material being wound to a coil-like shape so that the linear portion of the wire material constitutes the inner circumferential side thereof to thereby form a coil spring-like damper spring, the inner circumferential surface of the damper spring being thereby wound tightly around the outer circumferential surface in a large area.

In a third aspect of the invention, the boss portion is formed on the side surface of the rope reel which is opposed to the cam member, in such a manner that the boss portion is integral with the rope reel, the wound portion of the damper spring of substantially the whole length thereof being thereby wound tightly around the outer circumferential surface of the boss portion.

In a fourth aspect of the invention, the boss portion is formed on the side surface of the cam member which is opposed to the rope reel, in such a manner that the boss portion is integral with the cam member, the wound portion of the damper spring of substantially the whole length thereof being thereby wound tightly around the outer circumferential surface of the boss portion.

According to the recoil starter of the first aspect of the invention, in which the rotation of the rope reel is transmitted to the cam member via the coil spring-like damper spring engaged at both ends thereof with the rope reel and cam member, either one of the rope reel and cam member being provided with a boss portion the length of which is substantially equal to that of the wound portion of the damper spring, the inner circumferential portion of substantially the whole length of the damper spring being supported on the boss portion, the wound portion of substantially the whole length thereof being formed so that the wound portion of substantially the whole length thereof is wound tightly around the outer circumferential surface of the boss portion when the damper spring is elastically deformed due to the starting resistance of the engine, so that the damper spring of substantially the whole length thereof is wound tightly around the outer circumferential surface of the boss portion made of a single member, this preventing the occurrence of the entry of a part of the damper spring into the clearance between the boss portions and the resultant one-sided deformation of the damper spring, and the occurrence of great deformation of only the central portion of the damper spring and the breakage of the damper spring, so that the durability of the damper spring can be improved.

According to the second aspect of the invention, the cross-sectional shape of the wire material of which the damper spring is formed is set to a cross-sectional shape having at least one linear side, this wire material being wound so that the linear portion becomes the inner circumferential surface thereof to thereby form a coil spring-like damper spring, the inner side surface of the damper spring being thereby wound tightly in a large area around the outer circumferential surface of the boss portion, so that an impression of the damper spring is not left on the boss portion even when the damper spring is wound tightly around the outer circumferential surface of the boss portion formed on the rope reel or cam member due to an excessively large load occurring in the engine. Since the cross-sectional area of the wire material can be set larger than that of the wire material used in the related art recoil starter without increasing the size of the wire material in the direction of the thickness thereof, a damper spring of a larger elastic force can be formed without rendering the size of the whole of the damper spring larger. Furthermore, when the elastic force is unchanged, the number of winding is increased to enable a rotational force of a large angle of rotation to be accumulated. Therefore, a damper spring of a large elastic force and a damper spring of a high power accumulating capability of a larger angle of rotation can be held in a case of the same outer sizes. When the damper spring is a damper spring of the power accumulating capability of the same elastic force and the same angle of rotation, the recoil starter can be further miniaturized and weight-reduced.

According to the third aspect of the invention, the boss portion is formed on the side surface of the rope reel which is opposed to the cam member so that the boss portion is integral with the rope reel, and the wound portion of substantially the whole length of the damper spring is thereby wound tightly around the outer circumferential surface of the boss portion. Therefore, the occurrence of one-sided deformation of the damper spring due to the entry of a part thereof into a clearance between the boss portions, or the great deformation of only the central portion of the damper spring can be prevented, and the breakage of the damper spring is thereby prevented, so that the durability of the damper spring can be improved.

According to the fourth aspect of the invention, the boss portion is formed on the side surface of the cam member which is opposed to the rope reel so that the boss portion is integral with the cam member, and the damper spring of substantially the whole length is thereby wound tightly around the outer circumferential surface of the boss portion formed on the side surface of the cam member. Therefore, the occurrence of one-sided deformation of the damper spring due to the entry of a part of the damper spring into a clearance between the boss portions, or the great deformation of only the central portion of the damper spring is prevented, and the breakage of the damper spring is prevented, so that the durability of the damper spring can improved.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
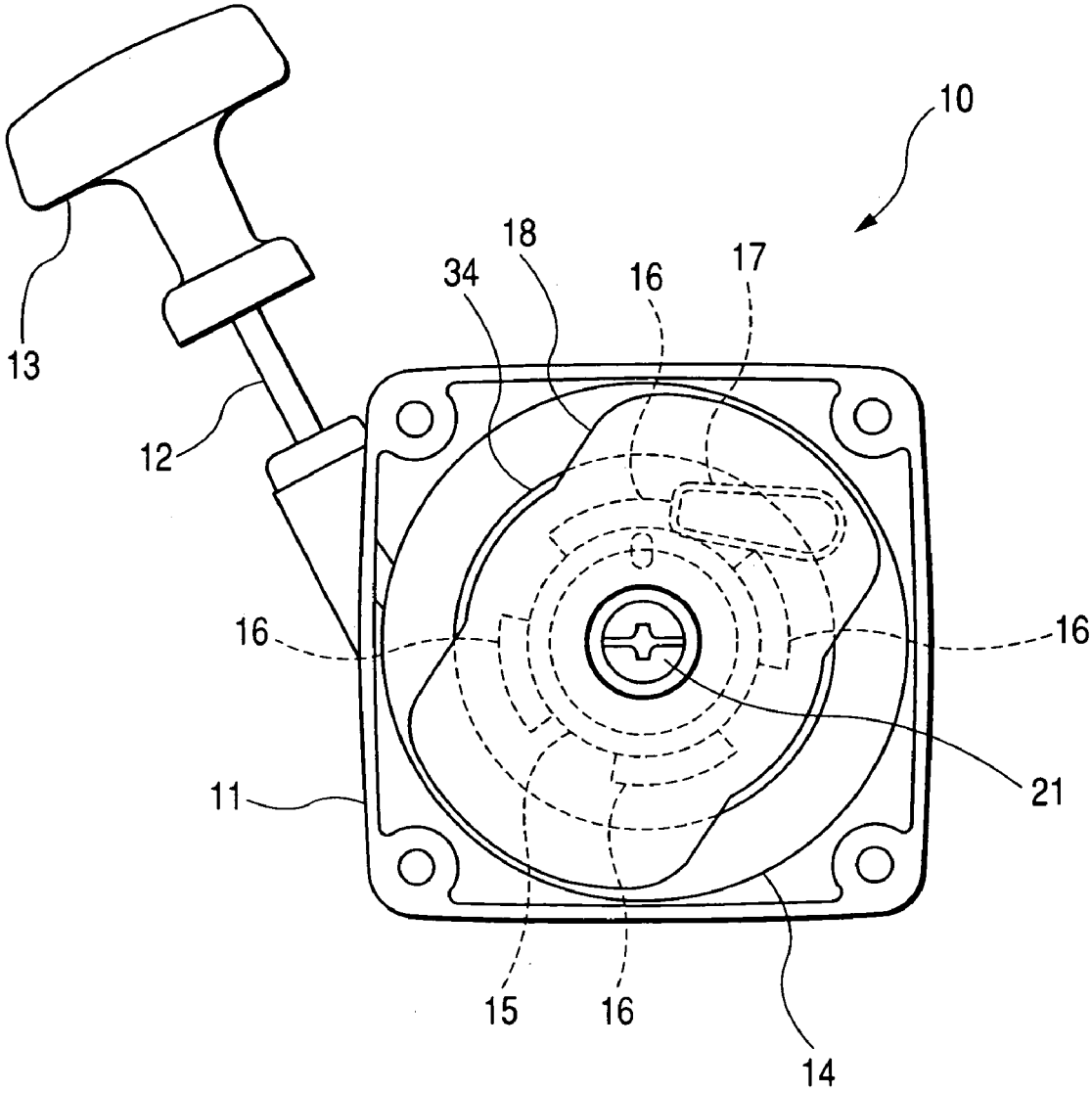
FIG. 1 is a front view the recoil starter in one embodiment of the present invention.

In the present invention, an object of preventing the breakage of the damper spring and improving the durability thereof by preventing the occurrence of great deformation of the damper spring even when the damper spring is wound tightly around the outer circumferential surface of the boss portion, which supports the damper spring, due to a large load on the engine is achieved by forming a boss portion the length of which is substantially equal to that of the wound portion of the damper spring on either the rope reel or the cam member, supporting the inner circumferential side of substantially the whole length of the damper spring on the boss portion, and setting the wound portion of substantially the whole length thereof so that the wound portion of substantially the whole length is wound tightly and uniformly around the outer circumferential surface of the boss portion when the damper spring is elastically deformed due to the starting resistance of the engine. The concrete embodiments of the invention will now be described.

FIG. 1 to FIG. 5 show a first embodiment of the recoil starter 10 according to the present invention. In the recoil starter 10 of this embodiment, a rope reel 14 around which a recoil rope 12 is wound, one end of which is drawn out from a case 11, is provided rotatably in the case 11. The rope reel 14 is adapted to be rotated when a handle 13 connected to the end of the recoil rope 12 is drawn. Owing to the rotation of the rope reel 14, a cam member 15 provided rotatably and coaxially with the rope reel 14 is rotated so as to engage a ratchet mechanisms 17 formed on a rotary member 18 fixed to an engine with a cam claw 16 formed on the outer circumferential surface of the cam member 15. A crankshaft fixed to the rotary member 18 is thereby rotated so as to start the engine.

Figure 2:
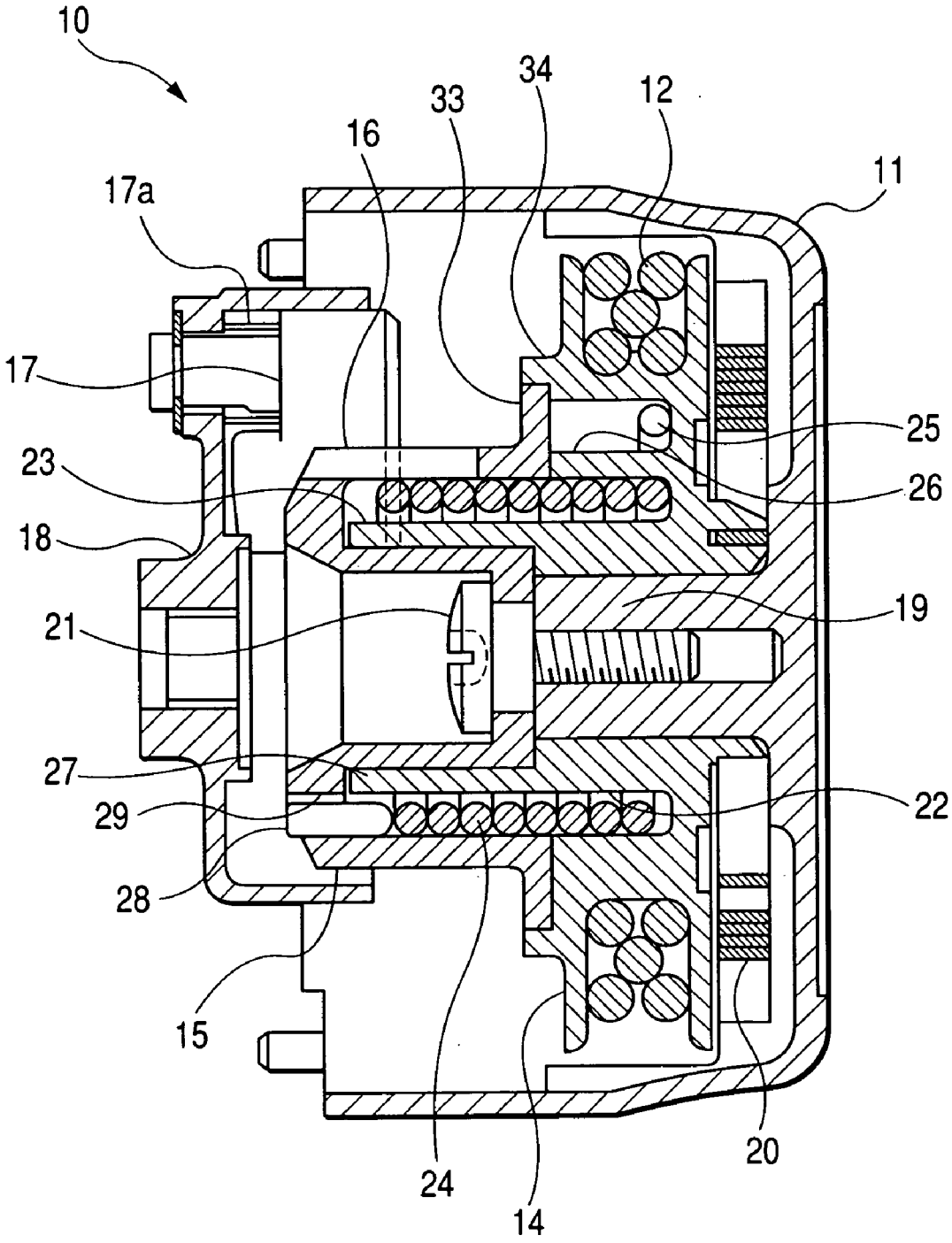
FIG. 2 is a longitudinally sectioned side view of the recoil starter identical with that shown in FIG. 1.

As shown in FIG. 2, the rope reel 14 around the outer circumferential surface of which the recoil rope 12 is wound is rotatably supported on a reel support shaft 19 made integral with and projecting inward from the case 11. The recoil rope 12 one end of which is drawn to the outside of the case 11 is wound around the outer circumferential surface of the rope reel 14, and the other end of which is fixed to the rope reel 14. When the handle 13 joined to the first-mentioned end, which is drawn out of the case 11, of the recoil rope 14 is drawn, the recoil rope 12 wound around the outer circumferential surface of the rope reel 14 is drawn out from the rope reel 14, so that the rope reel 14 is thereby rotated around the reel shaft 19.

Between a side surface of the rope reel 14 and an inner surface of the case 11, a recoil spiral spring 20 for rewinding the recoil rope 12, which is drawn out by rotating the rope reel 14 in a reverse direction by drawing the recoil rope 12, around the rope reel 14 is provided. The recoil flat spiral spring 20 is fixed at an inner circumferential side of one end portion thereof to the case 11, and at an outer circumferential portion of the other end portion thereof to the rope reel 14. When the recoil rope 12 is drawn to cause the rope reel 14 to be rotated, a rotational force is accumulated on the recoil flat spiral spring 20. When the drawing force of the recoil rope 12 is released, the rope reel 14 is thereby rotated in the reverse direction by the rotational force accumulated on the recoil flat spiral spring 20. The recoil rope 12 is thereby moved and rewound around the rope reel 14.

The cam member 15 adapted to transmit the rotation of the rope reel 14 to the rotary member 18 mounted on the crankshaft of the engine is fixed rotatably by a screw 21 to an end surface of the reel support shaft 19 formed on the case 11. The rope reel 14 is retained so that the rope reel 14 does not come off from the reel support shaft 19 via the cam member 15. The cam member 15 is provided on the outer circumferential surface thereof with a plurality of cam claws 16 in the circumferential direction in which cam claws and ratchet mechanism 17 are engaged with and disengaged from the ratchet mechanism 17 formed on the rotary member 18. When the cam claws 16 are engaged with the ratchet mechanism 17 of the rotary member, the rotation of the cam member 15 is transmitted to the rotary member 18, via which the crankshaft of the engine is rotated. The ratchet mechanism 17 in this embodiment is formed as a centrifugal clutch. After the engine is started, the rotary member 18 is driven by the engine, and this centrifugal force causes the ratchet mechanism 17 to be operated in the direction in which the ratchet mechanism 17 disengages from the cam claws 16. Consequently, the rotation transmission between the engine and cam member 15 is cut off so that the rotation of the engine is not transmitted to the coil starter 10.

Figure 3:
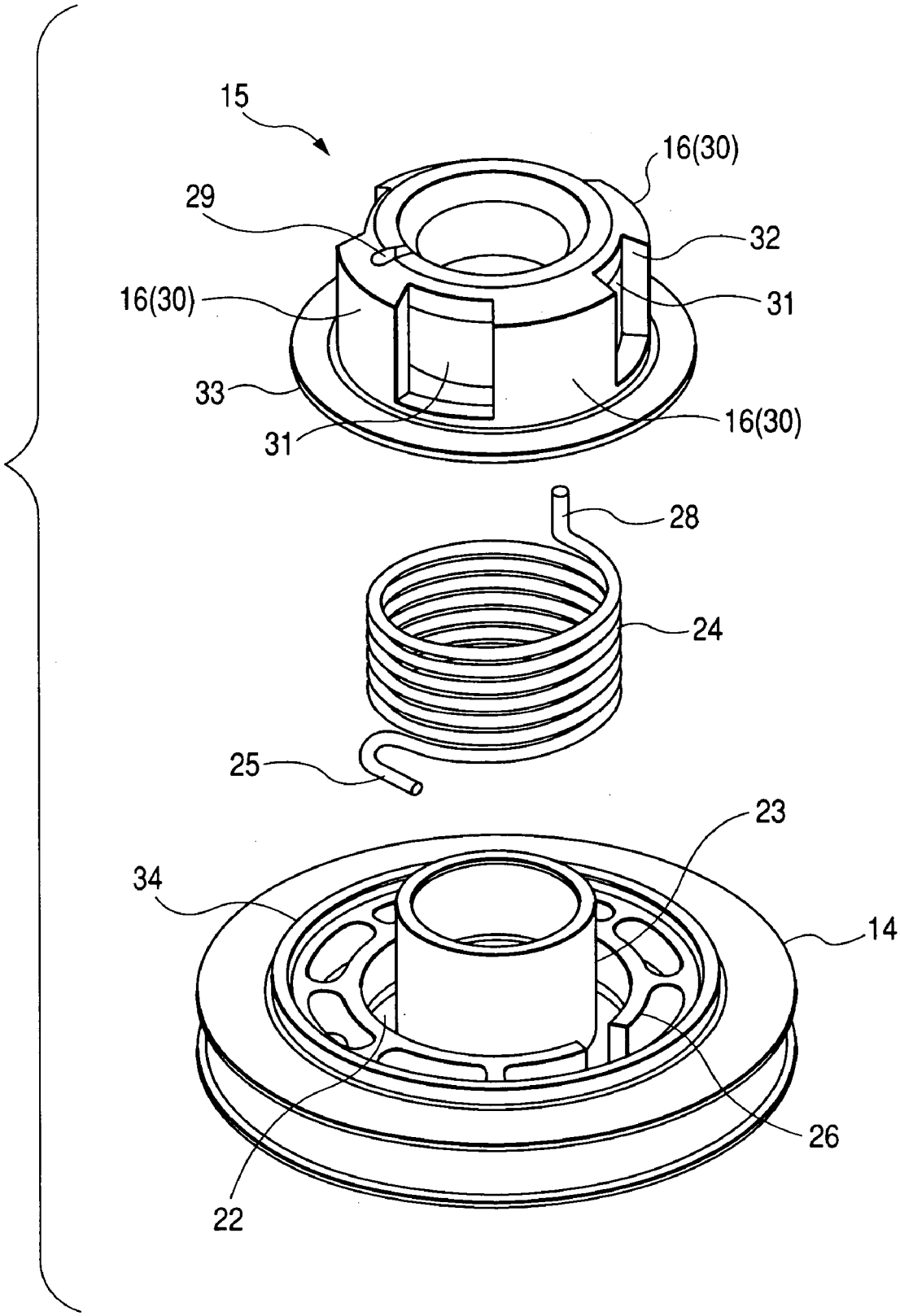
FIG. 3 is a perspective view of a rope reel, damper spring and a cam member which constitute the recoil starter identical with that shown in FIG. 1.

As shown in FIG. 2 and FIG. 3, the side surface of the rope reel 14 which is opposed to the cam member 15 is provided with an annular recess 22 opened toward the cam member 15, and the inner side portion of this annular recess 22 is projected toward the cam member 15 to form a cylindrical boss portion 23. A torsion coil spring-shaped damper spring 24 is fitted around the outer circumference of this cylindrical boss portion 23. This damper spring 24 is provided at one end portion thereof with an engagement end portion 25 formed by bending the same end portion to a horizontally extending U-shape. One end side of the cylindrically wound portion of this damper spring 24 is held in the annular recess, and the engagement end portion 25 is engaged with the engagement member 26 formed adjacently to the annular recess 22, so that the rope reel 14 and the same end portion of the damper spring 24 are thereby joined together. The axial length of the boss portion 23 and a total length of the wound portion of the cylindrically formed damper spring 24 are set substantially equal to each other.

The side surface of the cam member 15 which is opposed to the rope reel 14 is provided with an annular recess 27 formed so that the annular recess holds therein the boss portion 23 formed on the rope reel 14 and the other end part of the cylindrical wound portion of the damper spring 24 fitted around the outer circumference of the boss portion 23. The damper spring 24 is provided on the second-mentioned end side thereof with an axially bent engagement end portion 28. The engagement end portion 28 is inserted into the engagement hole 29 formed so as to extend from a bottom portion of the annular recess 27 of the cam member 15 and through an upper surface of the cam member 15. The second end side of the damper spring 24 is thereby joined to the cam member 15 in the rotational direction. This engagement hole 29 is formed long in the radial direction so that the engagement end portion 28 of the damper spring 24 can be radially moved.

As mentioned above, the rope reel 14 and cam member 15 are joined together in the rotational direction via the damper spring 24, and the rotation of the rope reel 14 driven by the drawing force of the recoil rope 12 is transmitted rotationally to the cam member 15 via the elastic force of the damper spring 24. The outer diameter of the boss portion 23 formed on the rope reel 14 is set smaller than the inner diameter of the damper spring 24 in a free state. The damper spring 24 is normally supported in a separated state from the outer circumferential surface of the boss portion 23. When the rotation of the cam member 15 is stopped due to the starting resistance of the engine during the time in which the rope reel 14 is rotated in the direction in which the engine is started, the damper spring 24 is distorted, and the diameter of the wound portion of the damper spring 24 decreases. As a result the damper spring 24 is wound tightly around the outer circumferential surface of the boss portion 23 formed on the rope reel 14, so that a further elastic deformation of the damper spring 24 is prevented.

Figure 4:
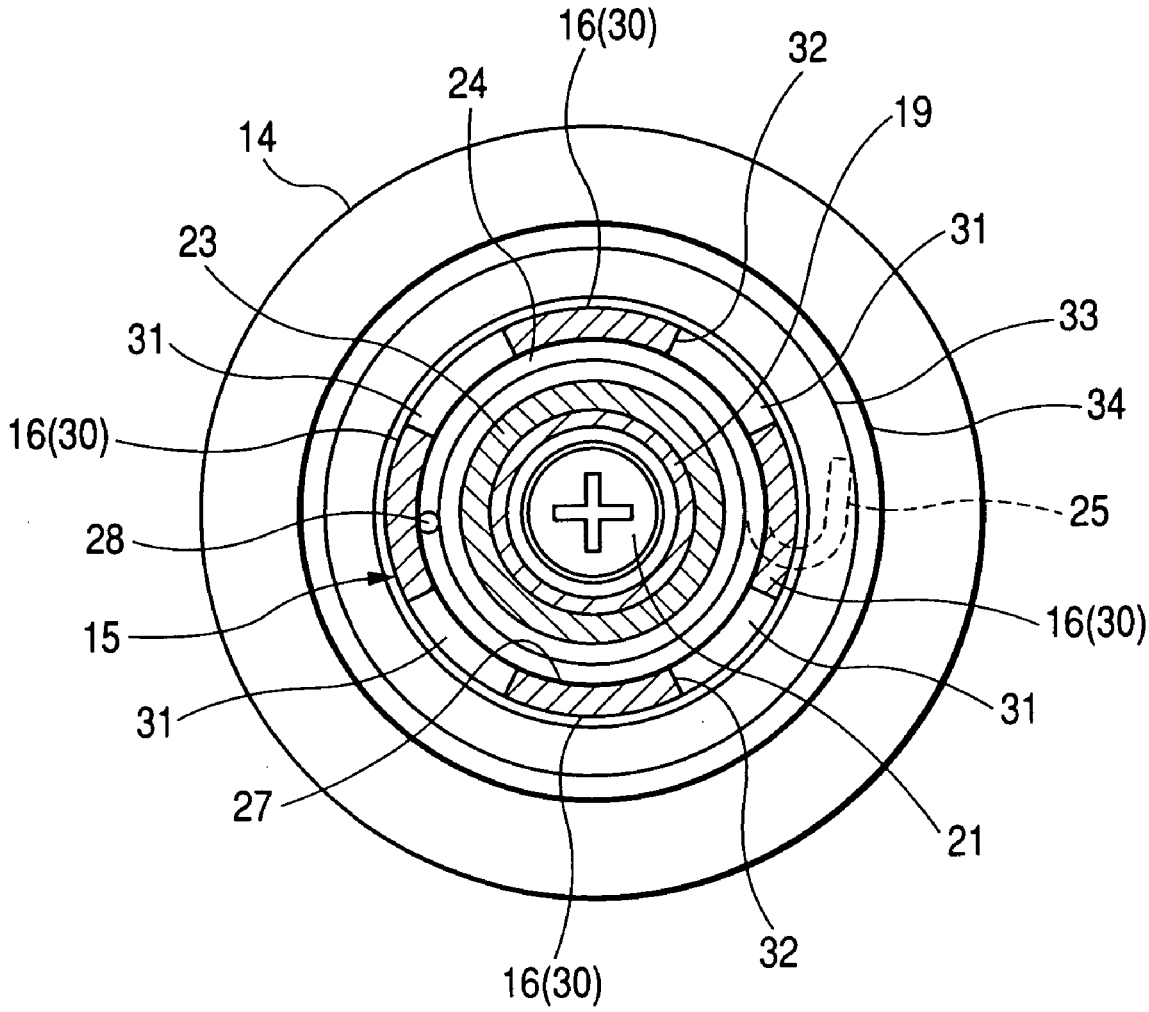
FIG. 4 is a sectional view taken along the line B—B in FIG. 2.

As shown in FIG. 3 and FIG. 4, the cam member 15 is provided with a plurality of circumferentially spaced cam claws 16 on the cylindrical outer circumferential wall 30 in which an annular recess 27 is formed, and a plurality of claws 16 spaced in the circumferential direction by the outer circumferential wall 30 in which the opening 31 is not provided is formed. The circumferentially directed engagement surfaces 32 of the cam claws 15 are engaged with the ratchet mechanism 17, and the rotation of the cam member 15 is thereby transmitted to the rotary member 18 via the ratchet mechanism 17. Since the cam claws 15 are thus formed by providing openings 31 in parts of the cylindrical outer circumferential wall 30, it is unnecessary that cam claws projecting further radially outward from the outer circumferential surface of the outer circumferential wall of the cam member 15 be formed. This enables the outer sizes of the cam member 15 to be formed smaller.

As shown in FIG. 2 and FIG. 3, one side, which faces the rope reel 14, of the outer circumferential wall 30 forming the annular recess 27 of the cam member 15 is provided with a flange 33 extending radially outward so as to be integral with the cam member 15. This flange 33 is held in the inner circumferential surface of an annular guide 34 formed on the side surface which faces the cam member 15 of the rope reel 14, to guide the relative rotation between the cam member 15 and rope reel 14. The cam member 15 is supported rotatably at the central portion thereof on a base portion of the screw 21 with respect to the reel shaft 19, and at an outer circumferential edge of the flange 33 on the annular guide 34 of the rope reel 14. Owing to this arrangement, the inclination of the cam member 15 due to an unbalanced load imparted to the cam member 15 is restrained, and the breakage of the cam member 15 due to the unbalanced load is prevented.

The operation of the recoil starter in the above embodiment will now be described. Before the engine is started, the ratchet mechanism 17 formed on the rotary member 18 joined to the crankshaft of the engine is disposed in a position in which the ratchet mechanism is engaged with the cam claws 16 formed on the cam member 15 owing to an operation of the ratchet spring 17*a*. When the recoil rope 12 is drawn, the rope reel 14 is rotated to cause the cam member 15 to be rotated therewith via the damper spring 24. The cam claws 16 of the cam member 15 come into engagement with the ratchet mechanism 17 to cause the rotary member 18 to be rotated via the ratchet mechanism 17, and the crankshaft of the engine joined to the rotary member 18 to be thereby rotated. When the rotational load on the rotary member 18 increases at this time due to the starting resistance of the engine to cause the rotation of the cam member 15 to be stopped, the damper spring 24 is distorted, and this load is absorbed, the rotational force of the rope reel side is accumulated in the damper spring 24.

Figure 5:
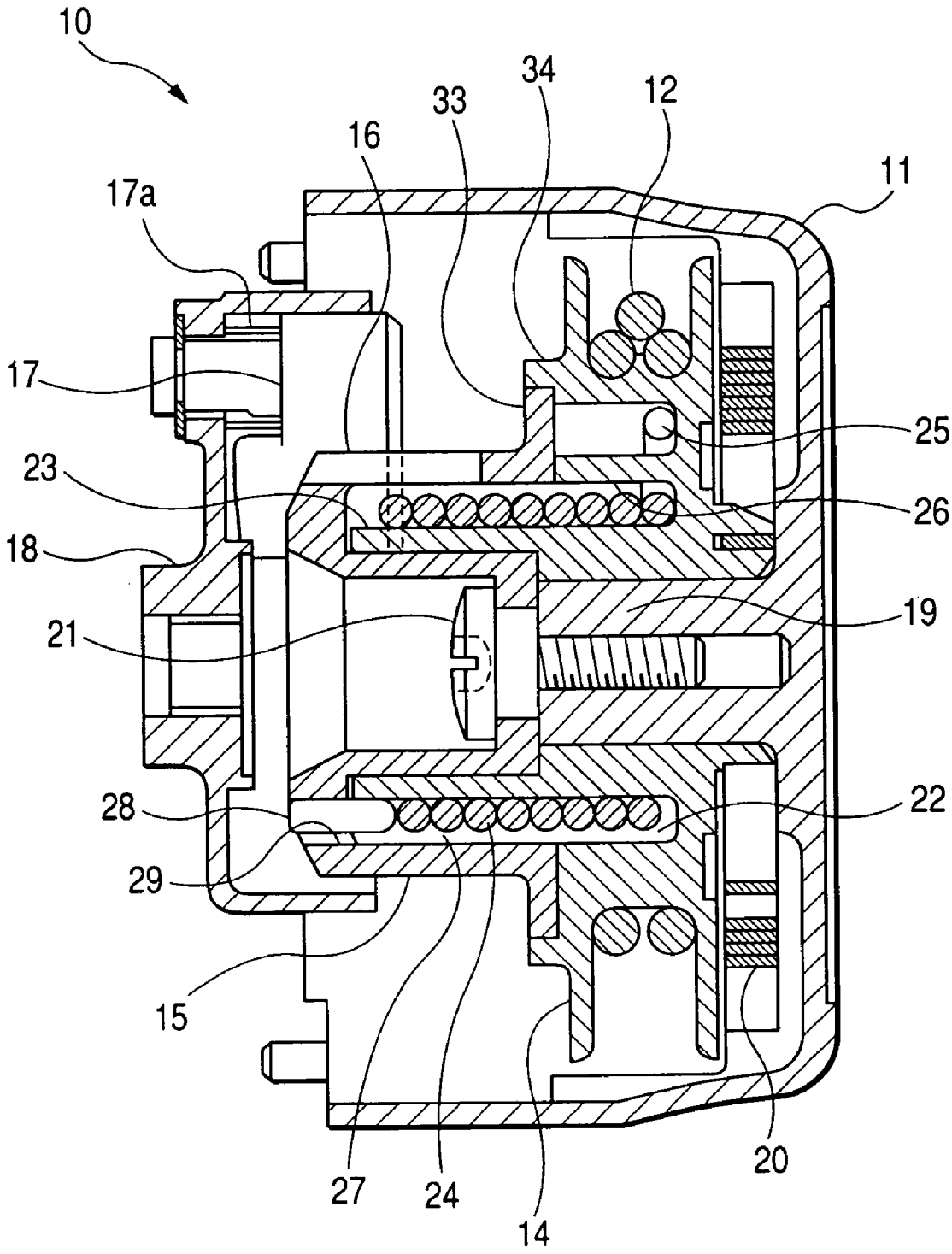
FIG. 5 is a longitudinally sectioned side view of the recoil starter identical with that shown in FIG. 2 with the damper spring in a tightly wound state.

When the starting load on the engine is extremely large, the damper spring 24 is distorted greatly as shown in FIG. 5 to cause the outer diameter of the wound portion of the damper spring 24 to decrease, and the same wound portion to be wound tightly around the outer circumferential surface of the boss portion 23 of the rope reel 14, no further stress coming to work on the damper spring 24. In this condition, the rope reel 14 and cam member 15 are joined together in one body by an operation of the spring clutch and owing to the damper spring 24. Since the damper spring 24 of the whole length thereof is wound tightly around the outer circumferential surface of the boss portion 23 formed on the rope reel 14, unnatural deformation of the damper spring 24 does not occur, nor does the breakage or a great decrease in the durability thereof occur. During this time, the engagement end portions 25, 28 at both ends of the damper spring 24 are moved inward. Therefore, the wound portion of the damper spring 24 of substantially the whole length is closely fitted around the outer circumferential surface of the boss portion 23, and an excessively large stress does not occur in both base portions of the damper spring 24

When the rope reel is rotated, so that the rotational force of the rope reel 14 exceeds the starting load on the engine, the rotational force of the rope reel 14 occurring due to the drawing of the recoil rope 12, and the rotational force accumulated in the rotary member 18 is discharged to the cam member side 15 and transmitted to the rotary member 18 via the ratchet mechanism 17. As a result, the crankshaft of the engine is rotated at a stroke to start the engine. When the engine is started with the crankshaft rotated, the ratchet mechanism 17 is turned outward by the effect of the centrifugal force, and disengaged from the cam claws 16 of the cam member 15, the rotation of the engine not being transmitted to the cam member. When the recoil rope 12 is loosened after the engine is started, the rope reel 14 is rotated in the reverse direction by the rotational force accumulated in the recoil spiral spring 20, to rewind the recoil rope 12 around the rope reel 14.

Figure 6:
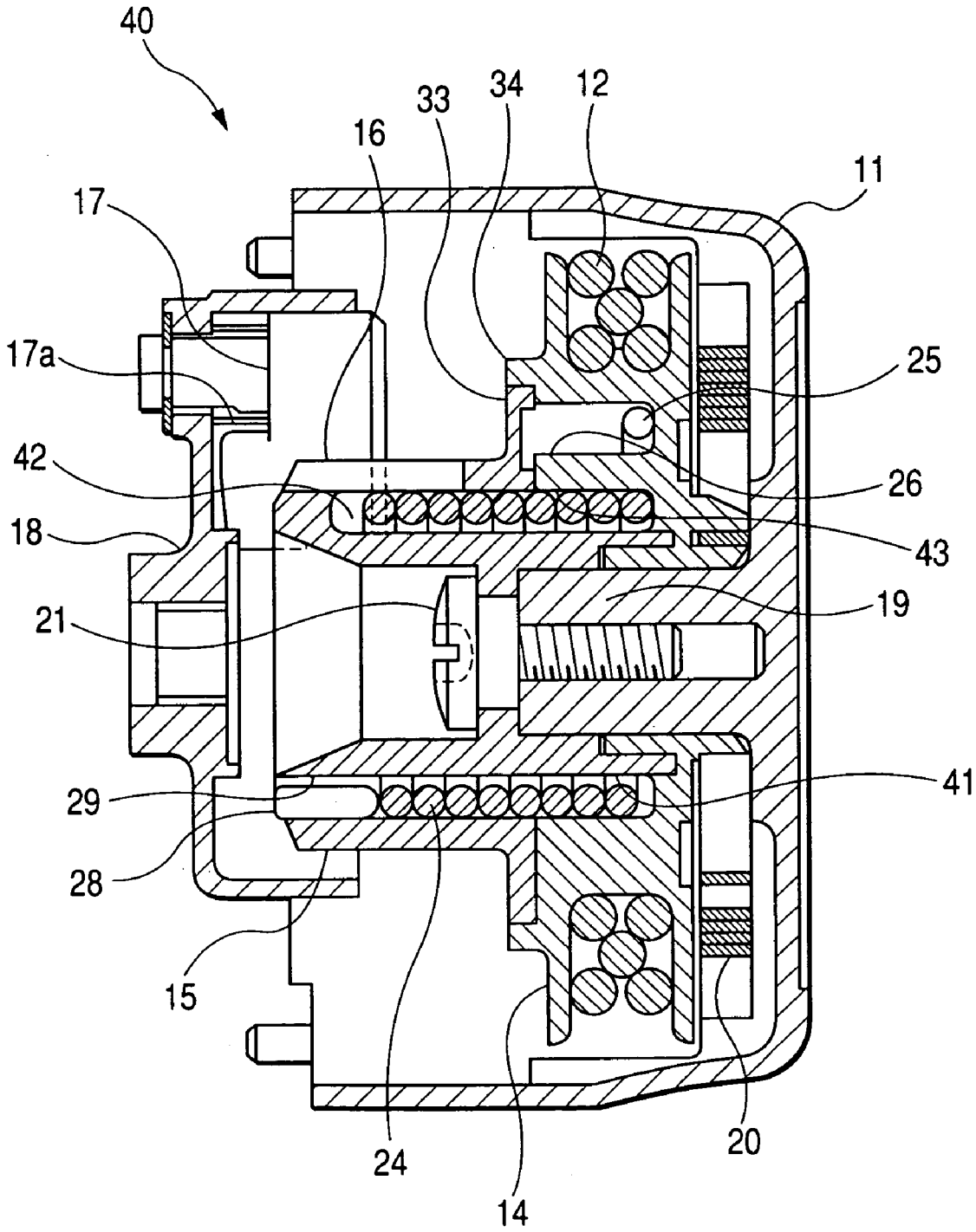
FIG. 6 is a longitudinal side view of the recoil starter in one embodiment of the present invention.

FIG. 6 shows a recoil starter 40 in a second embodiment of the present invention. In the recoil starter 40 in this embodiment, a boss portion 41 for supporting a wound portion of its substantially whole length of the damper spring 24 from the inner side thereof is formed on a cam member 15. As shown in FIG. 6, the side surface of the cam member 15 which is opposed to a rope reel 14 is provided with an annular recess 42 opened toward the rope reel 14. An inner side portion of this annular recess 42 is projected toward the rope reel 14 and forms a cylindrical boss portion 41 around the outer circumferential surface of which the damper spring 24 is fitted. One end side of the wound portion of the damper spring 24 is held in the annular recess 42, and an engagement end portion 28 formed so as to extend axially at one end side of the damper spring 24 is inserted through an engagement hole 29 formed so as to extend from a bottom portion of the annular recess 42 to an upper surface of the cam member 15. The mentioned end side of the damper spring 24 is thereby joined to the cam member 15 in the rotational direction. The axial length of the boss portion 41 formed on the cam member 15 is set substantially equal to a total length of the wound portion of the damper spring 24.

The side surface of the rope reel 14 which is opposed to the cam member 15 is provided with an annular recess 43 formed so as to hold therein the boss portion 41 formed on the cam member 51 and the other end part of the wound portion of the damper spring 24 fitted around the outer circumference of the boss portion 41. The second-mentioned end part of the wound portion of the damper spring 24 is held in the annular recess 43, and an engagement end portion 25 bent in the shape of the letter "U" and formed at the second-mentioned end side of the damper spring 24 is engaged with an engagement member 26 formed adjacently to the annular recess 43. Owing to this arrangement, the rope reel 14 and the first end side of the damper spring 24 are joined to each other.

When the recoil rope 12 is drawn with a load on the cam member 15 large to rotate the rope reel 14, the damper spring 24 is distorted greatly, so that the outer diameter of the wound portion of the damper spring 24 decreases. As a result, this portion of the damper spring 24 is wound tightly around the outer circumferential surface of the boss portion 41, and no more stress works on the damper spring 24. In this condition, the rope reel 14 and cam member 15 are joined together in a body by the damper spring 24 owing to the effect of a spring clutch, and the rotation of the rope reel 14 is transmitted directly to the cam member 14. Since the damper spring 24 of the whole length is wound tightly around the outer circumferential surface of the single boss portion 41, an unnatural deformation of the damper spring 24, the breakage or a great decrease in the durability of the damper spring 24 does not occur without encountering an unnatural deformation thereof.

Figure 7:
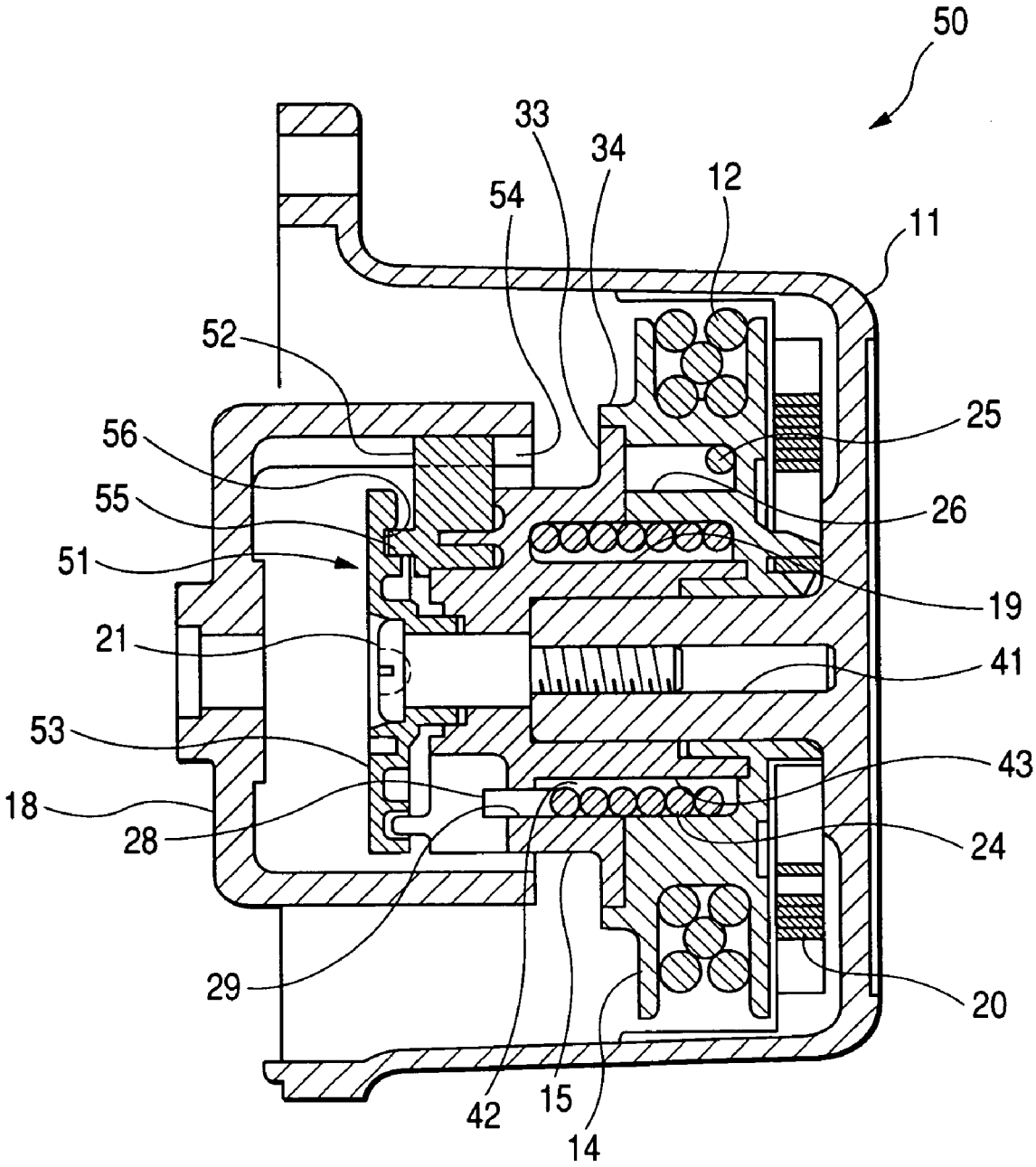
FIG. 7 is a longitudinal side view of the recoil starter in one embodiment of the present invention.

FIG. 7 shows a recoil starter 50 in a third embodiment. The recoil starter 50 in this embodiment is provided just as recoil starter in the above-described second embodiment on the side surface of a cam member 15 which is opposed to a rope reel 14 with an annular recess 42 opened toward the rope reel 14, and an inner portion of this annular recess 42 is projected toward the rope reel 14 to form a cylindrical boss portion 41, around the outer circumference of which a coil spring-like damper spring 24 is firmly fitted. A side surface of the rope reel 14 is provided with an annular recess 43 formed so that the boss portion 41 provided in the cam member 15 and an inner part of the wound portion of the damper portion 24 fitted firmly around the damper spring 24 are held.

In this recoil starter 50, a ratchet mechanism 51 adapted to transmit the rotation of the cam member 15 to a rotary member 18 fixed to a crankshaft of an engine is formed by ratchet claws 52 provided so as to be supported rotatably at a base end side thereof on an end surface of the cam member 15, a guide plate 53 which is supported so that the guide plate 53 is opposed to an end surface of the cam member 15 with a predetermined rotational resistance given to a reel shaft 19, and an engagement tooth 54 engageable with the ratchet claws 52 formed on an inner circumferential surface of the rotary member 18 formed to the shape of a cup so as to hold the ratchet claws 52 and guide plate 53 therein.

A projection 55 is formed on an upper surface of the ratchet claws 52, and a guide recess 56 for holding and guiding the projection 55 in a lower surface of the guide plate 17. When the cam member 15 is rotated in the engine starting direction via the rope reel 14, the ratchet claws 52 are turned so that the free ends of the ratchet claws 52 engage the engagement tooth 54. Thus, the rotary member 18 and cam member 15 are joined together in one body via the ratchet claws 52, and the cam member is rotated in the engine starting direction. In order to rotate the cam member 15 in the direction opposite to the engine starting direction, the ratchet claws 52 are turned so that the ratchet claws 52 disengage from the engagement tooth 54 of the rotary member 18 to thereby prevent the reverse rotation of the cam member 15 from being transmitted to the rotary member 18

In the recoil starter 50 in this embodiment, the projection 55 formed on the ratchet claws 52 rotatably held on the cam member 15 is loosely fitted in a guide recess 56 formed in the guide plate 53 to which a predetermined level of rotational resistance is given with respect to a reel support shaft 19. A ratchet mechanism 51 adapted to frictionally operate the ratchet claws 52 by the rotational operation of the cam member 15 is formed between the cam member 15 and rotary member 18. Owing to this arrangement, the damper spring 4 of the whole length is wound tightly around an outer circumferential surface of the boss portion 41. This enables a recoil starter of a static sound, which is capable of prolonging the durability of the damper spring 24, and which is capable of preventing the occurrence of intermittent sounds and the like of the ratchet claws 52, to be provided. The boss portion 41 in this embodiment is formed so as to project from the cam member 15 toward the rope reel. The boss portion 23 may also be formed at the side of the rope reel 14 so as to project toward the cam member 15 in the same manner as the boss portion in the above-described first embodiment.

Figure 8:
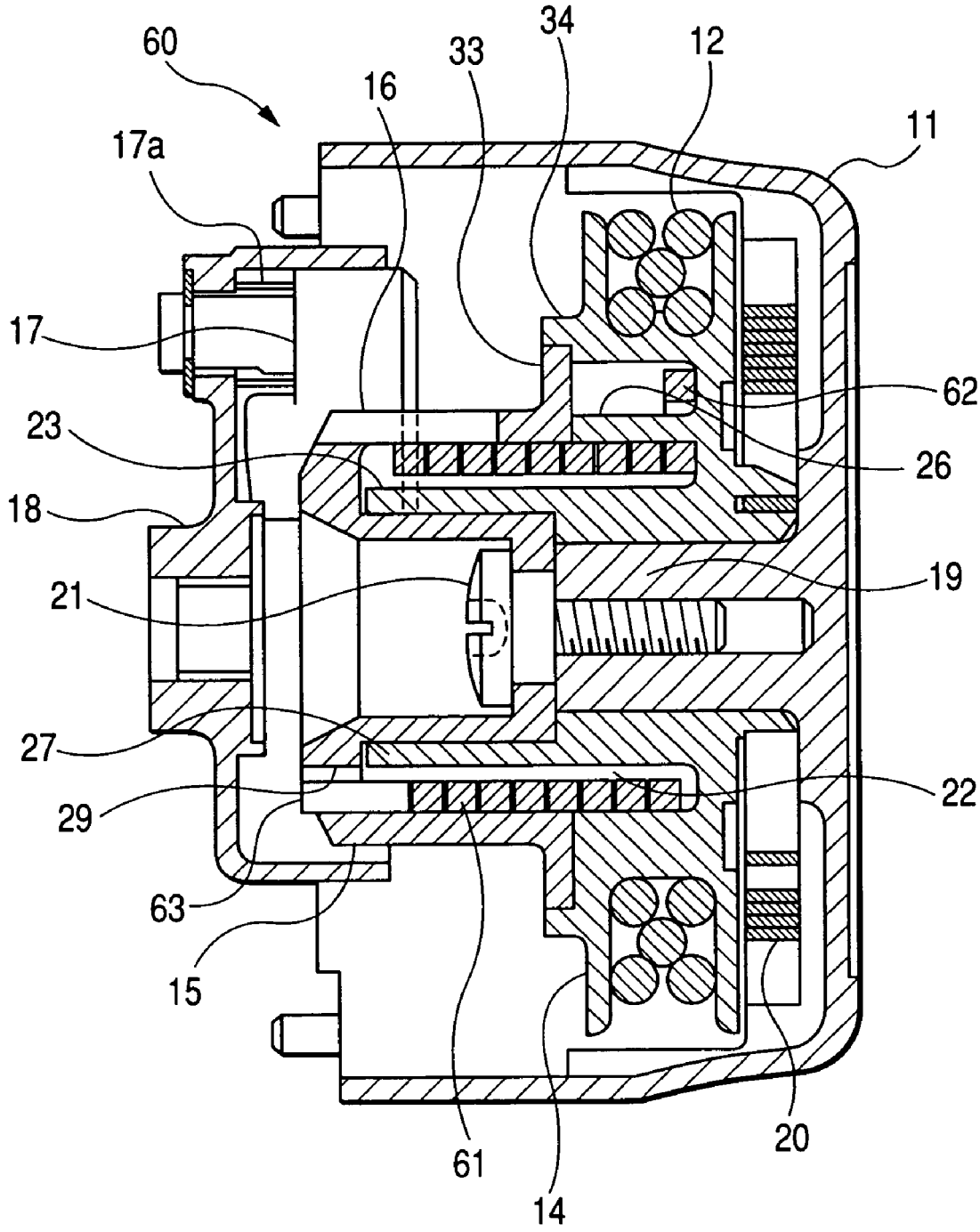
FIG. 8 is a longitudinal side view of the recoil starter in one embodiment of the present invention.
Figure 9:
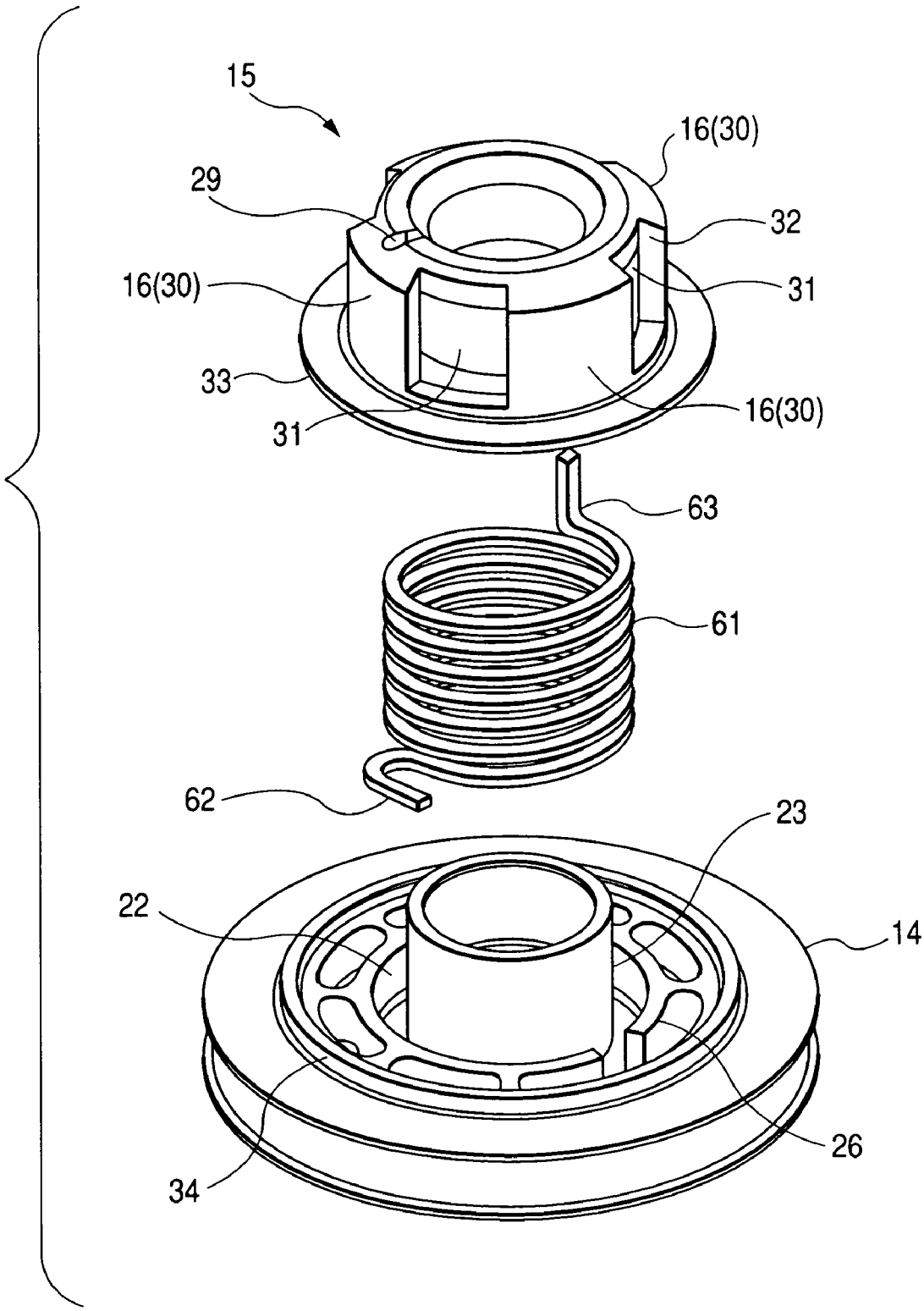
FIG. 9 is a perspective view of principal parts of the recoil starter in the embodiment of FIG. 8.

FIG. 8 and FIG. 9 show a recoil starter 60 in a fourth embodiment of the present invention. In the recoil starter 60 in this embodiment, a rope reel 14 around which a recoil rope 12 is wound and a cam member 15 provided with cam claws 16 with which a ratchet mechanism 17 in a rotary member 18 are rotatably supported in a case 11, and a cylindrical boss portion 23 projects from the rope reel 14 toward the cam member 15 in one body in the same manner as in the above-described embodiment. In the fourth embodiment, a damper spring 61 obtained by forming a cross-sectionally square wire material to the shape of a return coil spring is fitted around an outer circumference of the boss portion 23.

The damper spring 61 in this embodiment is formed to the shape of a return coil spring by spirally winding a plurality of times a cross-sectionally square steel wire, all the sides of which linearly extend, in such a manner that one linear side constitutes an inner circumferential side. The damper spring 61 is provided at one end side thereof with a horizontally bent U-shaped engagement end portion 62, and at the other end side thereof with an axial engagement end portion 63. The engagement end portion 62 is engaged with an engagement member 26 formed on an outer circumferential side of the boss portion 23 of the rope reel 14, and the engagement end portion 63 is inserted through an engagement hole 29 formed through an end surface of the cam member 15 in a rear portion of the annular recess 22 of the cam member 15. The rope reel 14 and cam member 15 are thereby joined to each other in the rotational direction via the damper spring 61.

The inner diameter of the damper spring 61 in a free condition is set larger than the outer diameter of the boss portion 23 formed on the rope reel 14. When the damper spring 61 is mounted on the boss portion 23, a clearance is formed between the inner circumferential surface formed by the linear side of the damper spring 61 and an outer circumferential surface of the boss portion 23. The inner circumferential surface of the damper spring 61 formed by a cross-sectionally square wire material is substantially cylindrical. When a predetermined level of rotational force is accumulated in the damper spring 61 due to the starting resistance of the engine, the diameter of a wound portion of the damper spring 61 decreases, and the wound portion is closely fitted in a large area around the outer circumferential surface of the boss portion 23 of the rope reel 14 and wound tightly and uniformly. As a result, a further elastic deformation of the damper spring, and a maximum stress working on the damper spring 61 is restricted.

Figure 10:
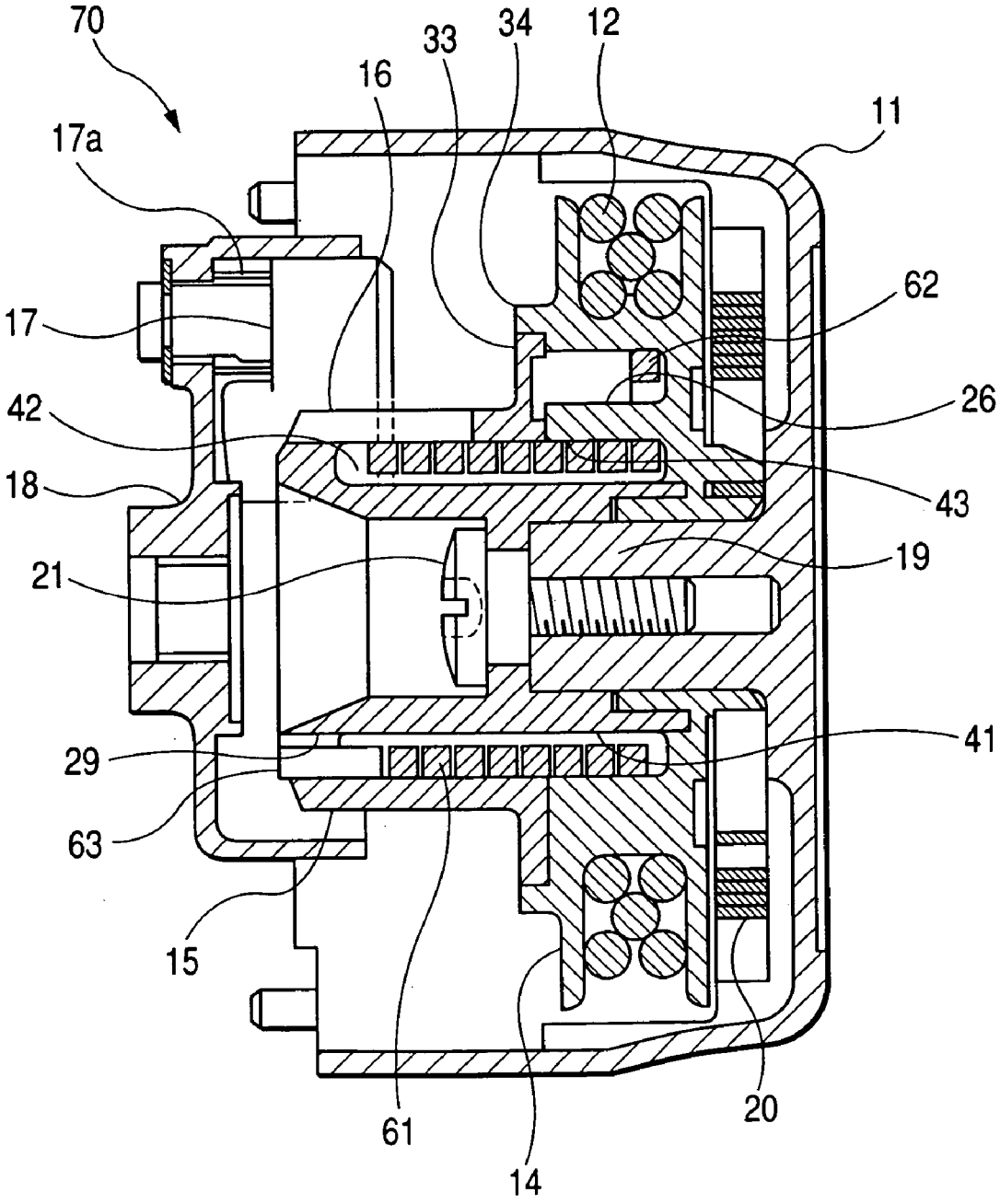
FIG. 10 is a longitudinally sectioned side view of the recoil starter in one embodiment of the present invention.

FIG. 10 shows a recoil starter 70 in a fifth embodiment of the present invention. In the recoil starter 70 in this embodiment, a rope reel 14 around which a recoil rope 12 is wound and a cam member 15 provided with cam claws 16 engaged with a ratchet mechanism 17 of a rotary member 18 are rotatably supported in a case 11, and a cylindrical boss portion 41 is formed so as to project from the cam member 15 in one body therewith toward the rope reel 14, in the same manner as in the above-described second embodiment. A damper spring 61 obtained by spirally winding a steel wire, which has a square cross-sectional shape similar to that of the steel wire used in the above-described third embodiment, around the outer circumference of the boss portion 41 formed on the cam member so that one linear side of the square cross section constitutes an inner side.

The engagement end portion formed on the first-mentioned end side of the damper spring 61 is engaged with the engagement member 26 formed on the outer circumference of the annular recess 43 of the rope reel 14, and the engagement end portion 63 formed on the second-mentioned end side of the damper spring 61 is inserted through an engagement hole 29 formed so as to extend toward an end surface of the cam member 15 in a rear portion of the annular recess 42 of the cam member 15. The rope reel 14 and cam member 15 are thereby joined together in the rotational direction via the damper spring 61. The construction of the other parts of the fifth embodiment is the same as that of the corresponding parts of the second embodiment.

According to the recoil starters 60, 70 in the above-described fourth and fifth embodiments, the damper spring 61 is formed by winding a wire material of a square cross section is wound so that a linear side of the cross section constitutes an inner side. This damper spring 61 is fitted around the boss portion 23 formed on the rope reel 14 formed to a length substantially equal to that of the wound portion of the damper spring 61, or around the boss portion 41 formed on the cam member 15. When the damper spring 61 is wound tightly around the outer circumferential surfaces of the boss portions 23,41, the inner surface formed by the linear side of the square cross section of the damper spring 61 is brought into close contact in a large area with the boss portions 23, 41. This prevents the occurrence of impression by the wire material on the outer circumferential surfaces of the boss portions 23, 41. The rope reel 14 and cam member 15 are joined together in one body owing to an operation of the spring clutch by the damper spring 61, and the rotation of the rope reel 14 is transmitted directly to the cam member 15.

Since the damper spring 61 is formed by a cross-sectionally square wire material, the cross sectional area of this damper spring can be set larger than that of a related art damper spring made of a cross-sectionally circular wire material. This enables the damper spring 61 of a larger elastic force to be formed without increasing the total cross-sectional area thereof. When the damper springs have the same elastic force, the number of winding is set larger, and the rotational force can be accumulated at a larger angle of rotation. Therefore, a damper spring 61 formed to have a larger elastic force, and a damper spring 61 capable of accumulating a rotational force at a larger angle of rotation can be held in a case of the same outer shape and sizes. When the damper springs 61 have the same elastic force and the same rotational force accumulating power, the dimensions and weight of the recoil starters 60, 70 can further be reduced.

Figure 11:
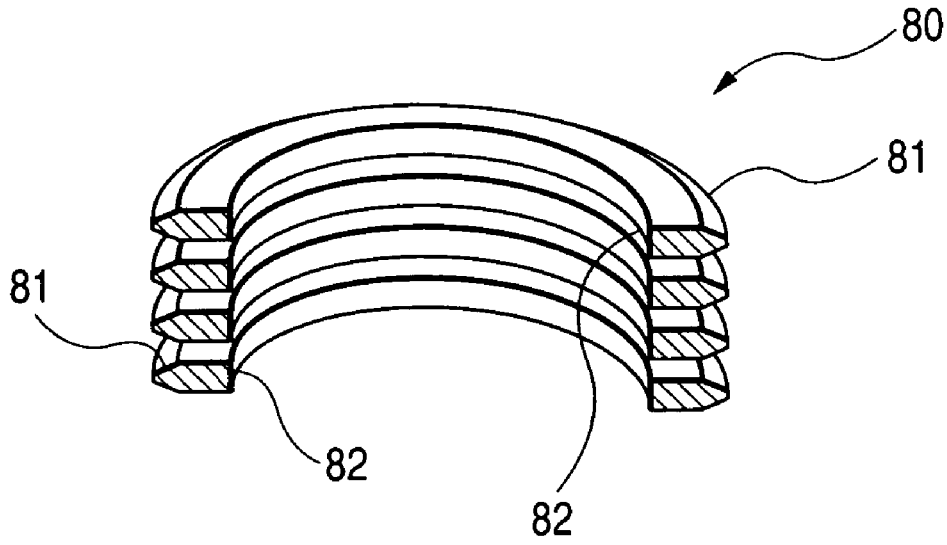
FIG. 11 is a partially sectioned perspective view of a part showing another example of the damper spring.
Figure 12:
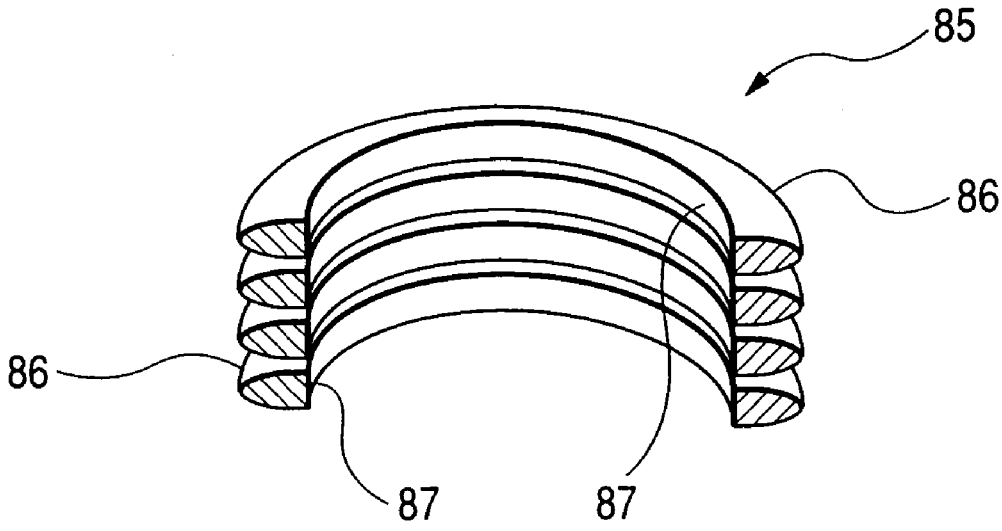
FIG. 12 is a partially sectioned perspective view of a part showing still another example of the damper spring.

FIG. 11 and FIG. 12 show other examples of the damper spring used for the recoil starters 60, 70 in the above-described fourth and fifth embodiments. In a damper spring 80 shown in FIG. 11, the cross-sectional shape of a wire material 81 of which the damper spring 80 is made is set hexagonal in which a linear side 82 is formed on the inner circumferential side wound like a coil. In a damper spring 85 in an example shown in FIG. 12, the cross-sectional shape of a wire material 86 of which the damper spring 85 is made is set semi-elliptic in which a linear side 87 is formed on the inner circumferential side wound like a coil. When the damper springs 80, 85 in these examples are tightened around the outer circumferential surface of a boss portion 23 formed on a rope reel 14 or a boss portion 41 formed on a cam member 15, or cylindrical wide surfaces of the boss portions 23, 41, so that the occurrence of impression by the wire materials 81, 86 around the boss portions 23, 41 and the spoiling of the durability of the parts can be prevented.

What is claimed is:

1. A recoil starter comprising:

a rope reel around which a recoil rope drawn out at one end thereof to the outside of a case is wound, and pivotably mounted on a reel shaft formed in the case;

a recoil spiral spring adapted to rotationally urge the rope reel in the direction in which the recoil rope is taken up;

a cam member which is pivotably mounted on the reel shaft so that the cam member is opposed to the rope reel, and which is adapted to transmit rotation to the engine via a ratchet mechanism; and a coil spring type damper spring engaged at both ends thereof with the rope reel and cam member, the rotational force of the rope reel being transmitted to the cam member via the elastic force of the damper spring, wherein:

the rotation of the cam member is transmitted to the engine via the ratchet mechanism to thereby start the engine;

a boss portion the length of which is substantially equal to the whole length of a wound portion of the damper spring is formed on either the rope reel or the cam member; and the inner circumference of the whole length of the damper spring is supported on the boss portion, whereby the wound portion of the whole length of the damper spring is tightly wound around the outer circumferential surface of the boss portion uniformly when the damper spring is elastically deformed due to the starting resistance of the engine.

2. A recoil starter according to claim 1, wherein a cross section of the wire material forming the damper spring is set to a cross-sectional shape at least one side of which extends linearly;

the wire material is wound so that the linear portion forms the inner circumferential side to form a coil spring-like damper spring; and the damper spring is formed so that the inner side surface thereof is wound tightly in a wide area around the outer circumferential surface of the boss portion.

3. A recoil starter according to claim 1, wherein the boss portion is formed on the side surface of the rope reel in one body therewith which is opposed to the cam member so that the wound portion of substantially the whole length of the damper spring is wound tightly around the outer circumferential surface of the boss portion.

4. A recoil starter according to claim 1, wherein the boss portion is formed on the side surface of the cam member in one body therewith which is opposed to the rope reel so that the wound portion of substantially the whole length of the damper spring is wound tightly around the outer circumferential surface of the boss portion.

* * * * *